US006520238B2

(12) United States Patent
Allsopp

(10) Patent No.: US 6,520,238 B2
(45) Date of Patent: Feb. 18, 2003

(54) FABRIC BLINDS

(75) Inventor: Reginald Charles Allsopp, Stockport (GB)

(73) Assignee: Louver-Lite, Limited, Cheshire (GB)

( * ) Notice: Subject to any disclaimer, the term of this patent is extended or adjusted under 35 U.S.C. 154(b) by 0 days.

(21) Appl. No.: 09/928,380

(22) Filed: Aug. 13, 2001

(65) Prior Publication Data

US 2002/0033243 A1 Mar. 21, 2002

(30) Foreign Application Priority Data

Aug. 15, 2000 (GB) ..... 0020110

(51) Int. Cl.[7] ..... A47H 5/00
(52) U.S. Cl. ..... 160/84.04
(58) Field of Search ..... 160/84.01, 84.04, 160/84.06, 84.03, 84.05, 348

(56) References Cited

U.S. PATENT DOCUMENTS

| | | | | |
|---|---|---|---|---|
| 2,350,094 A | * | 5/1944 | Butts | 160/84.04 |
| 3,322,182 A | | 5/1967 | Palella | |
| 3,487,875 A | | 1/1970 | Shukat et al. | |
| 4,501,311 A | | 2/1985 | Folland | 160/127 |
| 4,544,011 A | * | 10/1985 | Sawamura | 160/84.04 |
| 4,880,044 A | * | 11/1989 | Judkins | 160/84.04 |
| 4,974,656 A | * | 12/1990 | Judkins | 160/84.04 |
| 5,090,466 A | * | 2/1992 | Hong | 160/84.04 |
| 5,551,500 A | * | 9/1996 | Allsopp | 160/84.04 |
| 5,901,767 A | | 5/1999 | Ralton et al. | 160/84.04 |

FOREIGN PATENT DOCUMENTS

| | | |
|---|---|---|
| DE | 3418534 | 11/1985 |
| GB | 0549745 | 12/1942 |
| GB | 1497354 | 1/1978 |
| GB | 2261691 | 5/1993 |
| GB | 2270713 | 3/1994 |
| GB | 2351519 | 1/2001 |

OTHER PUBLICATIONS

Search Report Under Section 17, UK Patent Office, dated Oct. 18, 2001.
Search Report Under Section 17, UK Patent Office, dated Feb. 9, 2001.
"Austrian, Roman and Festoon Blinds", Advertising Brochure 1985, Silent Gliss Ltd.

* cited by examiner

*Primary Examiner*—David M. Purol
(74) *Attorney, Agent, or Firm*—Wiggin & Dana LLP; William A. Simons; Michael K. Kinney

(57) ABSTRACT

A Roman blind is provided which includes a head rail and a web of fabric material attached at a first end to the headrail. A pair of lifting cords extend from the headtail to a second end of the fabric web, to which they are attached. Two columns of guide elements are provided wherein each column guides a respective lifting cord. The guide elements of each column are arranged also to provide horizontal rows, about which the blind folds when raised. A pair of connecting tapes are disposed between the head rail and the second end of the fabric web. The tapes are secured to the fabric web by the guide elements, whereby unfolding of the fabric web is constrained by the tapes to a pre-defined maximum spacing between vertically adjacent pairs of guide elements, the maximum spacing between the vertically adjacent pairs of guide elements being less than the corresponding length of fabric web disposed between them. The blind further includes a backing sheet to cover the lifting cords, guide elements and connecting tapes to hide them from view.

31 Claims, 2 Drawing Sheets

FABRIC BLINDS

BACKGROUND OF THE INVENTION

1. Field of the Invention

This invention relates to an improved fabric blind and more particularly but not exclusively to the type of blinds known as Roman blinds which may be used to cover an aperture in a building, for example a window.

2. Discussion of Related Art

The type of blinds typically referred to as "Roman blinds" (hereinafter "Roman blinds") conventionally comprise a sheet of fabric material arranged between a top rail (head rail) and a lifting bar. A plurality of equally spaced horizontal bars are attached to the fabric sheet wherein each bar includes two or more guide means such that each guide means is slidably coupled to a respective lifting cord. The lifting cords are fixed to the lifting bar. This arrangement results in a blind which may be raised or lowered by raising or lowering the lifting cords. Raising the lifting cords raises the lifting bar until it engages a first horizontal bar. Both the lifting bar and the first horizontal bar are then raised together via continued raising of the lifting cords until the first horizontal bar engages a second horizontal bar and so on until the blind fabric no longer covers the aperture (i.e. where the lifting bar and each of the horizontal bars are grouped together at the head rail) or until it is in the desired position at which point the blind may be locked in a position by an appropriate lifting cord locking mechanism located in the head rail.

FR-A-2283278, EP-A-0451912 and GB-A-2246593 disclose different arrangements of the horizontal bars that can be used with roman blinds.

However, a major problem with this type of blind is the horizontal bars. These can become distorted by exposure to sunlight or heat which impairs both the operation and the aesthetic appeal of the blind. Efforts have been made to overcome this problem through use of materials such as extruded aluminium or plastics such as polycarbonate. However, these materials are relatively expensive and can have a significant effect on the costs involved in the production of such blinds.

Additionally, where the blind fabric is necessarily a relatively large fabric in order to cover a relatively large aperture, the weight contributed to the overall weight of the blind by the horizontal bars is significant and places additional strain on the lifting cords. In turn these cords must be made either from a stronger, and thus more expensive material, or from a material which has a greater diameter, which is unsightly.

SUMMARY OF THE INVENTION

According to a first aspect of the present invention, there is provided a fabric blind including a head rail; a web of fabric material attached at a first end to the head rail; at least one lifting cord extending from the head rail to a second end portion of the fabric material opposite to the first end, the or each lifting cord being secured to the second end portion of the fabric material, and a plurality of guide elements, each of the guide elements being a one-piece construction including a coupling portion slidably coupled to a respective lifting cord and a connecting portion releasably secured to the fabric material, wherein the guide elements are arranged in one or more arrays, such that the or each lifting cord is guided through a respective array of guide elements.

Preferably, the blind includes at least two lifting cords, which may be formed by two or more separate lifting cord elements or a single lifting cord arranged to act as separate lifting cord elements, and at least two respective arrays of guide elements, wherein the number of lifting cords is equal to the number of arrays of guide elements. The term "lifting cords" used herein refers to lifting cords which may be formed by a number of separate lifting cord elements or by a single lifting cord suitably arranged to form the desired number of lifting cord elements.

By using a plurality guide elements releasably secured to the blind fabric instead of horizontal bars, the problems associated with the known types of blind are ameliorated or overcome. In order to mimic the use of a horizontal bar whereby the present blind folds in substantially the same way as known blinds, the guide elements are preferably arranged in a grid-like configuration. That is to say, in use, the guide elements are arranged to form a number of columns and rows wherein the (in use) vertical columns of the guide elements guide respective lifting cords and the (in use) horizontal rows of the guide elements mimic the action of a horizontal bar and cause the blind fabric to fold in a way similar to known blinds.

In the present invention, the panels of the material defined by the portion of the fabric web lying between adjacent rows of guide elements have a curved cross-sectional profile even when the adjacent rows of guide elements are separated by the maximum permitted separation. This gives the panels an aerofoil or tear drop shape.

In a preferred embodiment, the fabric web is arranges between a top rail and a lifting bar and the lifting cords are attached to the second end portion of the blind fabric via the lifting bar. The lifting bar has the effect of ensuring that the second end portion of the blind fabric is maintained horizontal during the lifting or lowering of the blind fabric. Moreover, when a blind is allowed to lower without control, and it reaches the maximum extension permitted by the lifting cords, there is a relatively large force exerted on the joints between the lifting cords and the second end of the blind fabric such that the lifting cords may become detached from the blind fabric in such an instance. The use of a lifting bar helps to dissipate that force and greatly reduces the likelihood of the lifting cords becoming detached from the blind fabric.

The blind may include a border or fringe portion of material which extends beyond the second end portion of the fabric web. This border or fringe portion may be integral with the fabric web (i.e. the fabric web and the border or fringe portion are formed as a one-piece construction) or it may be attached to the fabric web. The border or fringe portion may provide an aesthetically pleasing decorative effect.

Thus, in embodiments where the border or fringe portion forms part of the blind fabric material, the or each lifting cord is attached to the fabric material at a point spaced from the (in use) bottom edge of the blind fabric material.

Each of the coupling portions of the guide elements may comprise a loop or eye through which the lifting cord may pass such that the eye or loop is slidably coupled with the respective lifting cord. The guide elements further include a connecting portion extending from the coupling portion. The connecting portion preferably is a T-shaped portion.

The guide elements are secured to the fabric web via the connection portion. This is desirable achieved by "punching" or urging the connecting portion through the fabric web such that a first part of the connecting portion (e.g. the shaft of a T-shaped connecting portion) extends through the fabric and a second part of the connecting portion (e.g. the cross bar of the T-shaped connecting portion) engages the (in use) front surface of the fabric web and thus resists removal of the guide element from the fabric web. By front surface it is meant the surface of the fabric web which is furthest from the coupling portion of the guide elements and which in use faces away from the building aperture.

Where a T-shaped connecting portion is provided, the cross bar of the T preferably includes flexible resilient arms. This makes it easier to secure the guide element to the flexible sheet element.

Thus, when using a T-shaped connecting portion, the cross bar of the T is positioned adjacent to a surface of the fabric web (the rear surface). A force is then applied to the guide element to urge the connecting portion through the fabric web. The portion of the shaft to which the cross bar in connected penetrates the flexible sheet. The flexible arms are engaged by the fabric web and contrarotate about the shaft until they lie substantially parallel thereto. This configuration of the connecting portion permits it to pass through the fabric web with relatively little resistance. Once the arms of the cross bar are no longer engaged by the fabric web, they snap or spring back to their original configuration, i.e. perpendicular to the shaft. The connecting portion thus releasably secures the guide element to the fabric web as the resilience of the arms of the cross bar resists removal of the connecting portion from the fabric web. Alternatively, a known type of "tag gun" may be used, which uses a hollow needle to secure the guide element to the fabric web.

By securing the connection portion of each guide element to the fabric web in this way, a relatively small hole is made through the fabric (i.e. the hole has a diameter which is only fractionally larger than the diameter of the first part of the connecting portion). This hole has a negligible effect on the structural integrity or strength of the fabric web. For example, where the fabric web comprises woven fabric, the act of locating the connecting portion of the guide element through it merely results in a re-alignment of the warp and weft strands of the woven fabric; it does not typically result in the strands being severed. Thus, as the strands are maintained intact, the structural integrity or strength of the woven fabric remains unchanged. By "structural integrity", it is meant the ability of the fabric web to resist tearing, fraying or other actions that result in damage to it.

Even if the web is non-woven sheet-like material, the relatively small hole made therethrough for the connecting portion would have a negligible affect on the inherent strength or structural integrity of the material. Accordingly, the material is considerably less likely to fray around the hole made by the connecting portion of the guide element.

Moreover, as the hole in the fabric web made by or for the connecting portion of the guide element, it has a diameter substantially the same as the diameter of the shaft of the connecting portion, and thus very little light can pass through the hole. Therefore, the light restricting or suppressing ability of the blind is substantially not affected.

If, as in a preferred embodiment, the cross-bar of the connecting portion is either transparent or coloured a similar colour or tone as the colour or tone of the fabric material, the cross bar becomes generally invisible to the naked eye when the blind is in use. This results in the blind effectively having no visible points or axes about which it may fold, which in turn increases the aesthetic appeal of the blind.

The blind further includes at least one flexible connecting tape disposed between the head rail and the second end of the fabric web, the tape being secured to the fabric web adjacent to, and preferably by, the connecting portions of at least some and more preferably all of the guide elements such that the unfolding of the fabric web is constrained by the connecting tape to a pre-defined maximum spacing between vertically adjacent guide elements.

The connecting tape may be secured flexibly to the fabric web by the connecting portions of the guide elements so that some play is possible. This arrangement permits the flexible connecting tape to move and fold more freely during raising or lowering of the blind. This in turn permits the fabric web to fold and move more freely. Desirably, the first part of the connecting portion, for example the shaft of the "T" where a T-shaped connecting portion is provided, passes through the fabric web and extends a short distance from both surfaces of the web. Accordingly, the length of the first part of the connecting portion substantially determines the distance the connecting portion may extend from either surface of the fabric web. The amount of play is determined by this length of the first part of the connecting portion; the greater this length, the more play will be present.

Advantageously the or each flexible connecting tape is a ribbon or similar thin strip of material and the attachment points for securement of the connecting tape to the fabric web are equidistantly spaced along the tape length such that the folds of the fabric web will be similarly equidistantly constrained.

In order that the rear of the blind (i.e. the surface of the blind which faces the architectural opening) presents an aesthetically pleasing appearance, a backing sheet may be included with the blind. The backing sheet is preferably secured to the fabric web such that it covers the lifting cords, the coupling portions of the guide elements, and the flexible connecting tapes. In such embodiments of the invention, the backing sheet may present the same appearance as the fabric web or it may be different, depending upon the desired aesthetic features of the blind. The backing sheet is perfectly secured to the fabric web at points adjacent the guide elements. This results in the backing sheet being capable of folding or unfolding in substantially the same manner as the fabric web. The backing sheet may be releasably attached to the fabric web in order that it may be removed for repair of the lifting cord(s), the guide elements and/or the flexible connecting tapes. In a preferred embodiment, the backing sheet may be releasably attached to the fabric web via I-shaped tags. However, any suitable method or apparatus for releasably attaching one sheet of a fabric material to another may be used, such as for example a hook and loop fastener (e.g. Velcro®) wherein one part of the fastener is attached to the fabric web and the other part is attached to the backing sheet.

BRIEF DESCRIPTION OF THE DRAWINGS

An embodiment of the invention will now be described by way of example only with reference to the accompanying drawings in which.

BRIEF DESCRIPTION OF PREFERRED EMBODIMENTS

Figure 1:
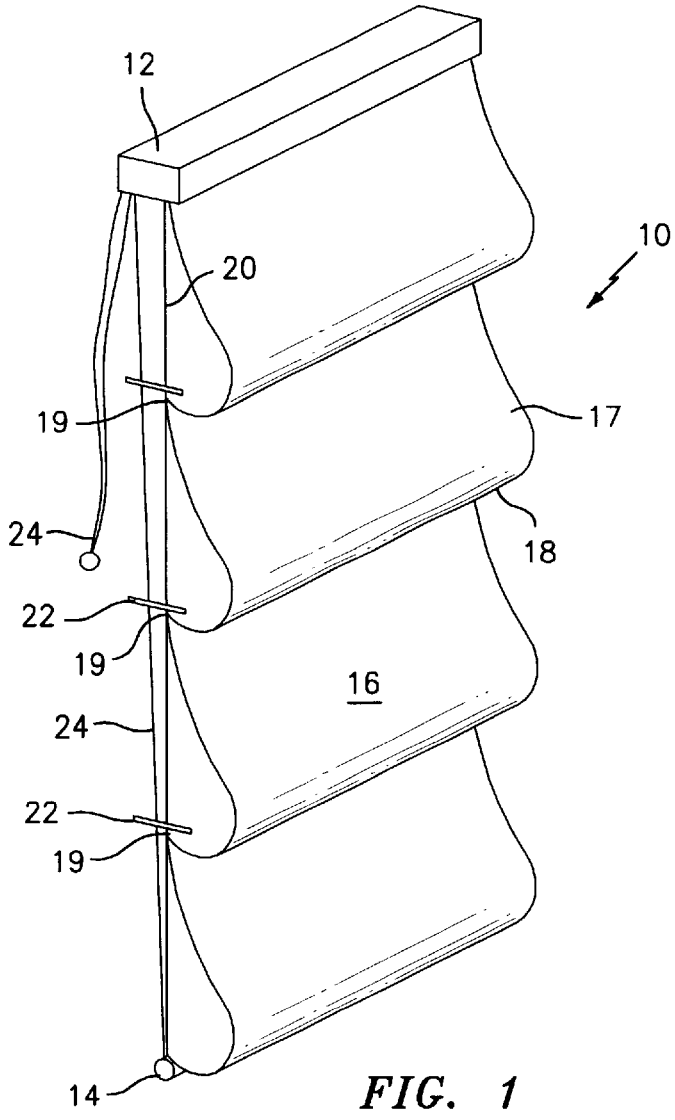
FIG. 1 is a perspective view of an embodiment of the present invention.

FIG. 1 shows a roman-type blind which is referred to generally by the reference numeral 10, the blind 10 having a top rail 12, a lifting bar 14 and a fabric web 16. The lifting bar 14 is arranged to be displaceable by a blind control means (not shown) between a lowered position and a raised portion.

Figure 4:
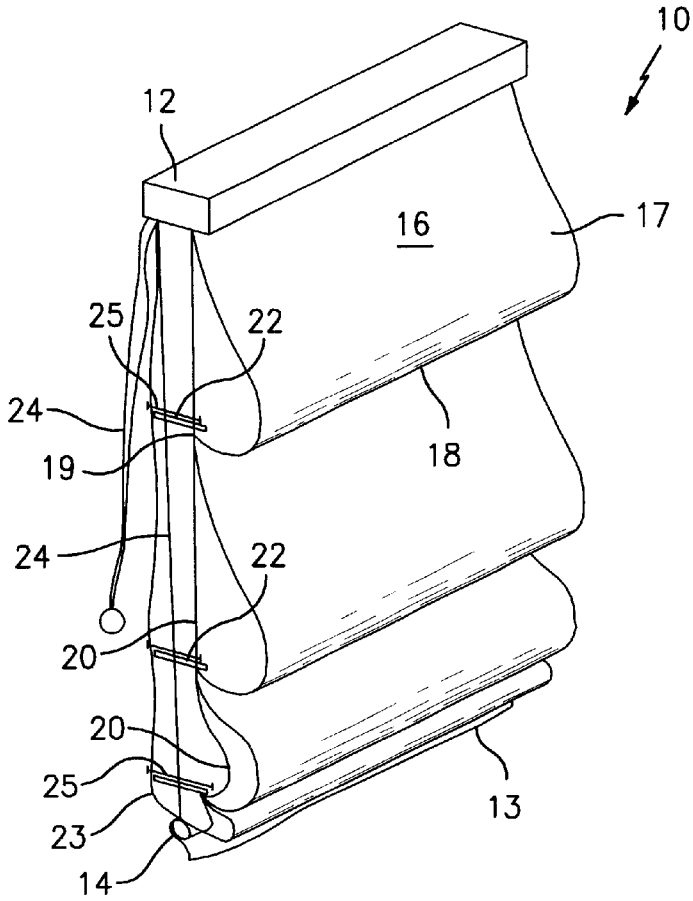
FIG. 4 is a perspective view of the blind shown in FIG. 1 in a partially raised configuration.

In the raised portion, the lifting bar 14 is substantially adjacent to the top rail 12 and in the lowered position, the lifting bar 14 is arranged parallel to the top rail 12 and spaced from it. FIG. 1 shows the lifting bar 14 in a lowered configuration and FIG. 4 shows it in a partially raised configuration.

The flexible fabric web 16, for example a cloth or other textile material, is secured at a first end to the top rail 12 and at a second end to the lifting bar 14. The flexible fabric web 16 is arranged to provide a number of soft folds 18, i.e. folds in the fabric which are not the result of creases or other sharply defined lines in the fabric material, such that panels 17 of fabric material having a curved cross-section are defined by the folds 18.

In use, when the lifting bar 14 is displaced away from or lowered from the top rail 12, the flexible fabric web 16 is unfolded so as to form a blind or cover between the head rail 12 and the lifting bar 14. It will be understood, however, that the flexible fabric web 16 has a length greater than the distance between the top rail 12 and the lifting bar 14, which results in a number of panels 17 and folds 18 between the top rail 12 and the lifting bar 14, even where the lifting bar is spaced away from the top rail 12 by the maximum permitted displacement. The retention of these curved panels of the fabric web is particularly aesthetically pleasing and a desired feature of the blind assembly 10.

In order to constrain equidistantly the folds 18, a flexible support tape 20 is arranged between the first end and the second end of the flexible fabric web 16. One end of the support tape 20 is fixed to the first end of the flexible fabric web and the other end of the support tape 20 is fixed to the second end of the flexible fabric web 16. The support tape 20 is also attached at predetermined positions along its length to portions of the flexible fabric web 16 by guide elements 22. Of course, it will be immediately apparent that more that one support tape may be used. In the embodiment shown in FIG. 1, the blind 10 includes two support tapes 20, one at each side of the fabric web 16 (although only one of the tapes 20 is shown in the figure).

The guide elements 22 are arranged in a grid-like configuration, whereby there are two vertical columns of the guide elements 22 (adjacent to a respective one of the vertical support tapes), and three horizontal rows of guide elements to provide the substantially horizontal folds 18 and corresponding substantially rectangular panels 17.

Figure 2:
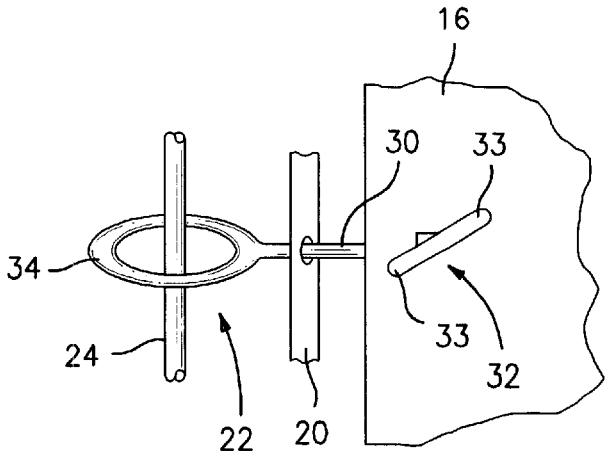
FIG. 2 is an enlarged view of a guide element, a lifting cord and a connecting tape shown in FIG. 1.

One of the guide elements 22 is shown in more detail in FIG. 2 and includes a substantially annular engagement portion 34 and a T-shaped connecting portion consisting of a shaft 30 extending radially from engagement portion 34 and a cross bar 32 transverse to the shaft 30, the cross bar 32 comprising a pair of flexible resilient arms 33.

The guide element 22 is a one-piece construction formed from a flexible resilient plastics material, e.g. nylon or polycarbonate.

As shown in FIG. 2, the support tape 20 is arranged on one side (the rear surface) of the fabric web 16. Each of the guide elements 22 is attached through both the support tape 20 and a connecting point 19 of the flexible fabric web 16 such that the shaft 30 passes through both the support tape and the fabric web 16. In this arrangement, each of the connecting points 19 of the fabric web 16 is retained in close proximity to the respective supporting tape 20.

In the process of producing the blind 10, each of the guide elements 22 is inserted through both the supporting tape 20 and the fabric web 16. Upon being inserted through the supporting tape 20 and a connecting point 19 of the fabric web 16, the two arms 33 of the cross bar 32 are forced towards the shaft 30 until they are lying substantially parallel thereto. The thus formed arrow-like configuration allows for easy passage of the connecting portion of the guide element 22 through the connecting tape 20 and the fabric web 16. Once the cross bar 32 has passed through both the connecting tape 20 and the fabric web 16, the two arms 33 snap back such that the connecting portion of the guide element 22 regains it T-shaped configuration. In an alternative method of inserting the guide elements 22 through the fabric web 16 and the supporting tape 20, a "tag gun" of the type typically used for inserting "I-shaped tags through material layers may be used.

The cross bar 32, once through both the connecting tape 20 and the fabric web 16 and in its T-shaped configuration, resists removal of the guide element 22 from the fabric web 16. The length of the shaft 30 is such that it extends a short distance beyond the fabric web 16 on the one side and a short distance beyond the connecting tape 20 on the other side. By having both the connecting tape 20 and the fabric web 16 connected by the shaft 30 of the guide element 22, there is small amount of play resulting from the length of the shaft 30 which permits the fabric web 16 and the connecting tape 20 to move and fold more freely during the opening or closing of the blind 10.

As can be seen from FIG. 1, the distance between vertically adjacent guide elements 22 secured to the supporting tape 20 is less than the corresponding length of the fabric web 16 which is disposed between those two adjacent guide elements 22. Thus, when the two adjacent guide elements 22 are separated by the maximum distance permitted by the supporting tape 20, the equivalent panel 17 of the fabric web 16 is not stretched flat and is free to adopt an aesthetically pleasing curved or tear drop-like configuration.

Each of the two lifting cords 24 passes through the annular coupling portion 34 of each guide element 22 of a respective guide element column and is fixed to a suitable point on the lifting bar. Each lifting cord 24 passes through the head rail via a conventional cord guide arrangement (not shown) and the free ends of the cords 24 depend from the head rail 12, which free ends may be manually seized and operated by a user. This arrangement of the lifting cord is entirely conventional.

Figure 3:
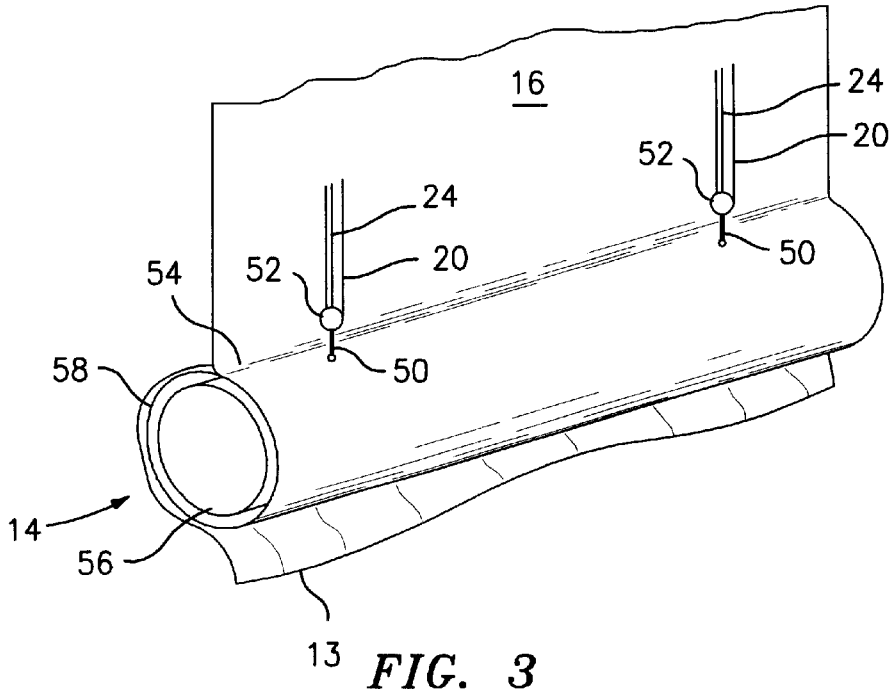
FIG. 3 is an enlarged view of the lifting bar shown in FIG. 1.

FIG. 3 shows in more detail how the lifting cords 24 are attached to the lifting bar 14.

The second end portion of the fabric web 16 is folded through 180° and stitched to a rear surface portion of the web 16, which is spaced from the second end portion, to form a seam 54 parallel to the head rail 12. This results in a tubular channel 58 being provided at the bottom (as shown in the Figures) of the fabric web 16. An extruded aluminum cylinder 56 is inserted into the tubular channel 58 and is a snug fit therein. Two eye bolts 50 are screwed into the aluminum cylinder 56 through a part of the fabric web 16. The eye bolts 50 are located adjacent to one end of a respective connecting tape 20. The lifting cords 24 are attached to an annular engagement portion 52 of a respective one of the eye bolts 50 in a conventional manner. In one embodiment, the fabric web 16 extends beyond the seam 54 to form a border or fringe portion 13. Alternatively, the fringe portion 13 is material attached to the second end portion of the fabric web 16.

Once the lifting cords 24, the flexible connecting tapes 20 and the guide elements 22 are secured to the fabric web 16, a backing sheet 23 (FIG. 4) is placed over the rear surface of the fabric web 16. The backing sheet 23 is sized to have a length substantially equal to that of the connecting tapes 20 and a width substantially equal to that of the fabric web 16. It is secured to the fabric web 16 via a plurality of I-shaped tags 25 wherein each I-shaped tag 25 passes through the backing sheet 23 and the fabric web 16, thereby releasably attaching one to the other. The I-shaped tags 25 are located adjacent the guide elements 22, so that the backing sheet 23 folds in a similar manner to the fabric web 16. By covering the lifting cords 24, the flexible connecting tapes 20 and the guide elements 22 with the backing sheet 23, a blind having an aesthetically pleasing rear surface, as well as an aesthetically pleasing front surface is provided.

This may be important where the blind is to be used for selectively covering or uncovering for example a window in a building, and the user of the building requires a blind that is pleasant to the eye when viewed either from within the building (i.e. the front surface of the blind) or from outside of the building (i.e. the rear surface of the blind).

This preferred embodiment has been described by way of an example and it will be apparent to those skilled in the art that many alternatives can be made that are still within the scope of the invention.

What is claimed is:

1. A fabric blind comprising:

a head rail;

a web of fabric material attached at a first end to said head rail;

at least one lifting cord extending from said head rail to a second end portion of the fabric material opposite to said first end, said at least one lifting cord being attached to said second end portion of said fabric web;

a plurality of guide elements, each of said guide elements being a one-piece construction including a coupling portion slidably coupled to a respective lifting cord and a connecting portion releasably secured to said fabric material, wherein said guide elements are arranged in one or more arrays; and at least one flexible connecting tape disposed between said head rail and said second end portion of the fabric web;

wherein one or more substantially vertical arrays of guide elements guide said at least one lifting cord and one or more substantially horizontal arrays of guide elements secure said connecting tape to the fabric web, whereby the unfolding of the fabric web is constrained by said connecting tape to a pre-defined maximum spacing between vertically adjacent pairs of guide elements, the maximum spacing between said vertically adjacent pairs of guide elements being less than a corresponding length of the fabric web disposed between them such that said corresponding length of said fabric web forms an aesthetically pleasing shape.

2. A fabric blind according to claim 1 wherein the blind includes at least two lifting cord elements and an equal number of arrays of guide elements.

3. A fabric blind according to claim 2 wherein the guide elements are arranged in a grid-type configuration whereby each of said plurality of arrays of guide elements forms a column and respective guide elements of each column are also arranged to form rows perpendicular to the columns.

4. A fabric blind according to claim 1, wherein the blind further includes a lifting bar and said at least one lifting cord is attached to the second end portion of the fabric material via said lifting bar.

5. A fabric blind according to claim 1, wherein the coupling portion of each guide element comprises a body portion defining a loop or eye through which the respective lifting cord passes.

6. A fabric blind according to claim 1, wherein the connecting portion of each guide element comprises a T-shaped portion.

7. A fabric blind according to claim 1, wherein at least the connecting portion of the guide elements is transparent.

8. A fabric blind according to claim 1, wherein at least the connecting portion of the guide elements is coloured substantially the same colour as the fabric material.

9. A fabric blind according to claim 1, wherein the connecting tape is secured to the fabric web by the connecting portion of the guide elements.

10. A fabric blind according to claim 9 wherein the guide elements which secure the connecting tape to the fabric material are equidistantly spaced along the tape length such that the folds of the fabric web will be similarly equidistantly constrained when the fabric web is in its maximum unfolded state.

11. A fabric blind according to claim 1 wherein the blind includes a border or fringe portion of material which extends beyond the second end portion of the fabric web.

12. A fabric blind comprising:

a head rail;

a web of fabric material attached at a first end to said head rail;

at least one lifting cord extending from said head rail to a second end portion of the fabric material opposite to said first end, said at least one lifting cord being attached to said second end portion of the fabric web;

a plurality of guide elements, each of said guide elements being a one-piece construction including a coupling portion slidably coupled to a respective lifting cord and a connecting portion releasably secured to said fabric material, wherein said guide elements are arranged in one or more arrays;

at least one flexible connecting tape disposed between said head rail and said second end portion of the fabric web;

wherein one or more substantially vertical arrays of guide elements guide said at least one lifting cord and one or more substantially horizontal arrays of guide elements secure said connecting tape to the fabric web, whereby the unfolding of the fabric web is constrained by said connecting tape to a pre-defined maximum spacing between vertically adjacent pairs of guide elements, the maximum spacing between said vertically adjacent pairs of guide elements being less than a corresponding length of the fabric web disposed between them such that said corresponding length of said fabric web forms an aesthetically pleasing shape; and a backing sheet secured to a rear surface of said fabric web, whereby said backing sheet covers said at least one lifting cord, the coupling portions of said guide elements and said at least one flexible connecting tape.

13. A fabric blind according to claim 12, wherein the blind includes at least two lifting cord elements and an equal number of arrays of guide elements.

14. A fabric blind according to claim 13, wherein the guide elements are arranged in a grid-type configuration whereby each of said plurality of arrays of guide elements forms a column and respective guide elements of each column are also arranged to form rows perpendicular to the columns.

15. A fabric blind according to claim 12, wherein the blind further includes a lifting bar and said at least one lifting cord is attached to the second end portion of the fabric material via said lifting bar.

16. A fabric blind according to claim 12, wherein the coupling portion of each guide element comprises a body portion defining a loop or eye through which the respective lifting cord passes.

17. A fabric blind according to claim 12, wherein the connecting portion of each guide element comprises a T-shaped portion.

18. A fabric blind according to claim 12, wherein at least the connecting portion of the guide elements is transparent.

19. A fabric blind according to claim 12, wherein at least the connecting portion of the guide elements is coloured substantially the same colour as the fabric material.

20. A fabric blind according to claim 12, wherein the connecting tape is secured to the fabric web by the connecting portion of the guide elements.

21. A fabric blind according to claim 20, wherein the guide elements which secure the connecting tape to the fabric material are equidistantly spaced along the tape length such that the folds of the fabric web are similarly equidistantly constrained when the fabric web is in its maximum unfolded state.

22. A fabric blind according to claim 12, wherein the blind includes a border or fringe portion of material which extends beyond the second end portion of the fabric web.

23. A fabric blind according to claim 12, wherein the backing sheet is secured to the fabric web at points adjacent to at least some of the guide elements.

24. A fabric blind according to claim 23, wherein the backing sheet is releasably secured to the fabric web.

25. A fabric blind according to claim 24, wherein the backing sheet is releasably secured to the fabric web via I-shaped tags.

26. A fabric blind comprising:

a head rail;

a web of fabric material attached at a first end to said head rail;

at least two lifting cords extending from said head rail to a second end portion of the fabric material opposite to said first end, each lifting cord being attached to said second end portion of the fabric web;

a plurality of guide elements, each of said guide elements being a one-piece construction including body portion defining a loop or eye slidably coupling the guide element to a respective lifting cord and a T-shaped connecting portion releasably securing the guide element to said web of fabric material, wherein said guide elements are arranged in a grid-type configuration having at least two columns and at least two rows such that each lifting cord is guided through a respective column of guide elements; and at least two flexible connecting tapes disposed between said head rail and said second end portion of the fabric web, each connecting tape being secured to the fabric web by at least some guide elements of a respective column of guide elements, whereby the unfolding of the fabric web is constrained by the connecting tapes to a pre-defined maximum spacing between vertically adjacent pairs of guide elements, the maximum spacing between said vertically adjacent pairs of guide elements being less than a corresponding length of the fabric web disposed between them such that said corresponding length of said fabric web forms an aesthetically pleasing shape.

27. A fabric blind according to claim 26, wherein the blind further includes a lifting bar and each lifting cord is attached to the second end portion of the fabric material via the lifting bar.

28. A fabric blind according to claim 26, wherein at least the connecting portion of the guide elements is transparent.

29. A fabric blind according to claim 26 wherein at least the connecting portion of the guide elements is coloured substantially the same colour as the fabric material.

30. A fabric blind according to claim 26 wherein the guide elements which secure the connecting tape to the fabric material are equidistantly spaced along the tape length such that the folds of the fabric web are similarly equidistantly constrained when the fabric web is in its maximum unfolded state.

31. A fabric blind according to claim 26 wherein the blind includes a border or fringe portion of material which extends beyond the second end portion of the fabric web.

* * * * *